US008896643B2

(12) United States Patent
Nakade

(10) Patent No.: US 8,896,643 B2
(45) Date of Patent: Nov. 25, 2014

(54) IMAGE FORMING APPARATUS

(71) Applicant: Konica Minolta, Inc., Chiyoda-ku (JP)

(72) Inventor: Yohei Nakade, Okazaki (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/143,603

(22) Filed: Dec. 30, 2013

(65) Prior Publication Data

US 2014/0192122 A1 Jul. 10, 2014

(30) Foreign Application Priority Data

Jan. 8, 2013 (JP) ..... 2013-001100

(51) Int. Cl.
*B41J 2/385* (2006.01)
*G03G 15/043* (2006.01)

(52) U.S. Cl.
CPC ..... *G03G 15/043* (2013.01)
USPC ..... 347/118; 347/253; 347/112; 347/135; 347/119; 399/51; 399/58; 399/198

(58) Field of Classification Search
USPC ..... 347/118, 253, 112, 135, 119, 129, 132; 399/51, 56, 58, 67, 198
See application file for complete search history.

(56) References Cited

U.S. PATENT DOCUMENTS 6,061,534 A 5/2000 Okada et al.

FOREIGN PATENT DOCUMENTS

| | | | |
|---|---|---|---|
| JP | 11-102099 | A | 4/1999 |
| JP | 2003-233224 | A | 8/2003 |
| JP | 2004-070010 | A | 3/2004 |

*Primary Examiner* — Henok Legesse
(74) *Attorney, Agent, or Firm* — Buchanan Ingersoll & Rooney

(57) ABSTRACT

An image forming apparatus including: a photoreceptor; a charger configured to charge a photoreceptor surface; an optical scanning device configured to expose the photoreceptor surface to form an electrostatic latent image thereon; a developing device configured to develop the electrostatic latent image to form a toner image thereon; a transfer member configured to transfer the toner image to a sheet; a fixing device configured to fix the toner image thereon; and a control unit configured to carry out exposure amount control for formation of an image having a pattern with a spatial frequency from 0.1 c/mm to 3.0 c/mm so that after the exposure, there will be an electric potential difference V1 between an edge portion and a non-edge portion of the pattern and so that there will be an electric potential difference V2 larger than V1 between an edge-surrounding portion and the other portions of a non-image area.

7 Claims, 9 Drawing Sheets

IMAGE FORMING APPARATUS

This application is based on Japanese Patent Application No. 2013-001100 filed on Jan. 8, 2013, the content of which is incorporated herein by reference.

BACKGROUND OF THE INVENTION

1. Field of the Invention

The present invention relates to an image forming apparatus that can control the exposure amount.

2. Description of Related Art

As a conventional image forming apparatus of this kind, for example, there is known an apparatus disclosed by Japanese Patent Laid-Open Publication No. 2004-70010. In this image forming apparatus, a glossiness detector for detecting the glossiness of an image on a sheet is disposed downstream of a fixing device with respect to a sheet feeding direction. The image forming apparatus forms a patch image representing a gradation pattern of three gray levels, which are greatly different in the amount of adherent toner, as a test pattern for glossiness measurement. The glossiness detector detects the glossiness of each patch. The image forming apparatus changes parameters for image formation such that the glossiness differences between the gray levels can be minimized.

In a conventional image forming apparatus, it is intended to prevent a decrease in glossiness of an output image by applying parameter changes to the whole image. Depending on the pattern of the image, for example, whether or not it has spatial periodicity, however, there may be problems, such as excessive toner supply, as well as a decrease in glossiness.

SUMMARY OF THE INVENTION

The present invention provides an image forming apparatus that can prevent a decrease in glossiness of an output image while preventing an increase in toner consumption.

According to an aspect of the present invention, an image forming apparatus comprises: a photoreceptor a charger configured to charge a specified electric potential on a surface of the photoreceptor; an optical scanning device configured to emit a light beam to expose the surface of the photoreceptor charged by the charger to form an electrostatic latent image on the surface of the photoreceptor; a developing device configured to develop the electrostatic latent image formed by the optical scanning device to form a toner image on the surface of the photoreceptor; a transfer member configured to transfer the toner image formed by the developing device to a sheet and for feeding the sheet; a fixing device configured to apply heat and pressure to the sheet fed from the transfer member to fix the toner image on the sheet; and a control unit configured to control an exposure amount from the optical scanning device.

In the image forming apparatus, for formation of an image having a pattern with a spatial frequency within a range from 0.1 c/mm to 3.0 c/mm, the control unit is configured to carry out exposure amount control such that an exposure amount on an edge portion of the pattern becomes higher than an exposure amount on a non-edge portion of the pattern by a first exposure amount so that after the exposure, an electric potential at the edge portion of the pattern will be different from an electric potential Vi at the non-edge portion of the pattern by a first voltage V1 and such that an exposure amount on an edge-surrounding portion of a non-image area adjoined to the edge portion of the pattern becomes higher than an exposure amount on portions of the non-image area other than the edge-surrounding portion by a second exposure amount so that after the exposure, an electric potential at the edge-surrounding portion of the non-image area will be different from an electric potential Vo at the other portions of the non-image area by a second voltage V2 that is larger than the first voltage V1.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Basic Idea

The inventor examined how people feel about image degradation and degraded images. As a result, the inventor found out that people generally recognize a color change and/or a glossiness change as an image-quality change. Also, it was found out that especially a glossiness change on the periphery of a pattern with a certain spatial frequency makes a great effect on the visual recognition of image quality.

The inventor also analyzed the causes of a glossiness change on the periphery of a pattern. As a result, the inventor found out that such a glossiness change is caused by decreases in the amount of adherent toner in edge portions E of a pattern L in a preceding process of a fixing process in the image forming apparatus, as shown by the topmost level to the second to the lowermost level in FIG. 1A.

Figure 1A:
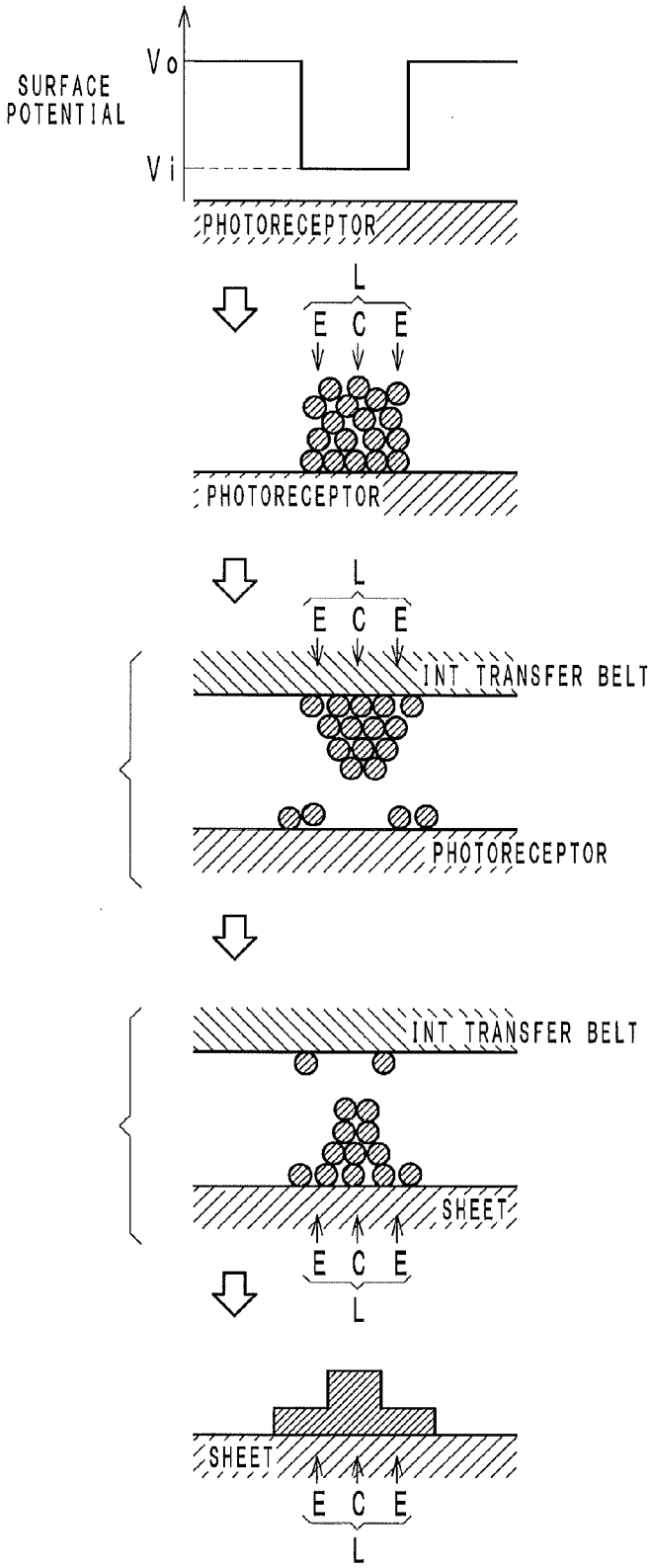
FIG. 1A is a view showing state transition of toner in a case where edge intensification is not carried out.

As shown by the lowermost level in FIG. 1A, if a fixing device crushes the pattern L, of which edge portions E have decreased amounts of adherent toner, the center portion C of the pattern L is subjected to appropriate pressure and heat. Thereby, in an image that has passed through the fixing process, the center portion C of the pattern L has appropriate glossiness. However, the edge portions E of the pattern L have insufficient glossiness since in the edge portions E, the amount of adherent toner has decreased.

In view of the background, if a decrease in glossiness is expected to occur in edge portions of a pattern that is likely to be seen as noise, it is desirable to increase the amount of toner in the edge portions so as to prevent a decrease in glossiness.

First, the inventor examined what patterns are likely to be visually recognized as noise. As a result, the inventor found out that a glossiness change in edge portions of a pattern with a spatial frequency from 0.1 c/mm to 3.0 c/mm is likely to be visually recognized as noise because of humans' characteristics of visual sensitivity to the spatial frequency of a pattern.

Next, the inventor studied what process is to be applied to prevent the trouble effectively. Prior to that, the inventor examined why the amount of adherent toner decreases, and as a result, the following matters (1) and (2) became clear.

(1) At a developing process, there is a large electric potential difference between an image area and a non-image are, and therefore, a strong electric field (i.e., edge-restraining electric field) is generated at a border (i.e., edge portion) between the image area and the non-image area. The edge-restraining electric field acts on charged toner to cause the charged toner to be adsorbed on the photoreceptor drum. Accordingly, even if a force to move the toner from the photoreceptor drum to the intermediate transfer belt is applied to the toner in a primary transfer area, the force is not strong enough to move the toner in the edge portion from the photoreceptor drum to the intermediate transfer belt against the action of the edge-restraining electric field. Thus, primary transfer of the toner in edge portions to the intermediate transfer belt is insufficient, and the amount of adherent toner in edge portions decreases.

(2) In the primary transfer area, at a border (i.e., edge portion) between an image area and a non-image area, there is a gap between the intermediate transfer belt and the photoreceptor drum. Discharge occurs in the gap, whereby the charge state of the toner around the edge portion is changed to an inappropriate state. The change results in an inability of the toner in the edge portion to move to the intermediate transfer belt. Hence, the amount of adherent toner in edge portions decreases.

Mainly because of the reasons (1) and (2), conventionally, patterns such as the pattern L are subjected to what is called an edge intensification process. The edge intensification process is to increase the amount of adherent toner in the edge portions E of an image, and is a process of making the electric potential at the edge portions E lower than the electric potential Vi at the center portion C by V1 by increasing the exposure amount on the edge portions E. With the edge intensification process, the glossiness in the edge portions E and the glossiness in the center portion C can be equalized, and the image quality can be improved. However, in the conventional edge intensification process, the electric potential difference $\Delta V$ between the pattern L and a non-image area W is large, and accordingly, the restraining force acting on the toner in the edge portions E to force the toner to be adsorbed on the photoreceptor drum is large. Consequently, only a part of the toner supplied to the edge portions E is transferred to the intermediate transfer belt, and the remaining part of the toner is left on the photoreceptor drum, which increases the amount of waste toner.

In order to reduce the waste of toner, in this embodiment, the following processes are carried out for formation of a pattern with a spatial frequency within a range from 0.1 c/mm to 3.0 c/mm: the exposure amount on the edge portions E is increased so as to increase the amount of adherent toner in the edge portions E; and additionally, the electric potential difference between the image area I and the non-image area W is decreased so as to weaken the force of restraining the toner in the edge portions E on the photoreceptor drum. The details of the processes are described below.

Figure 1B:
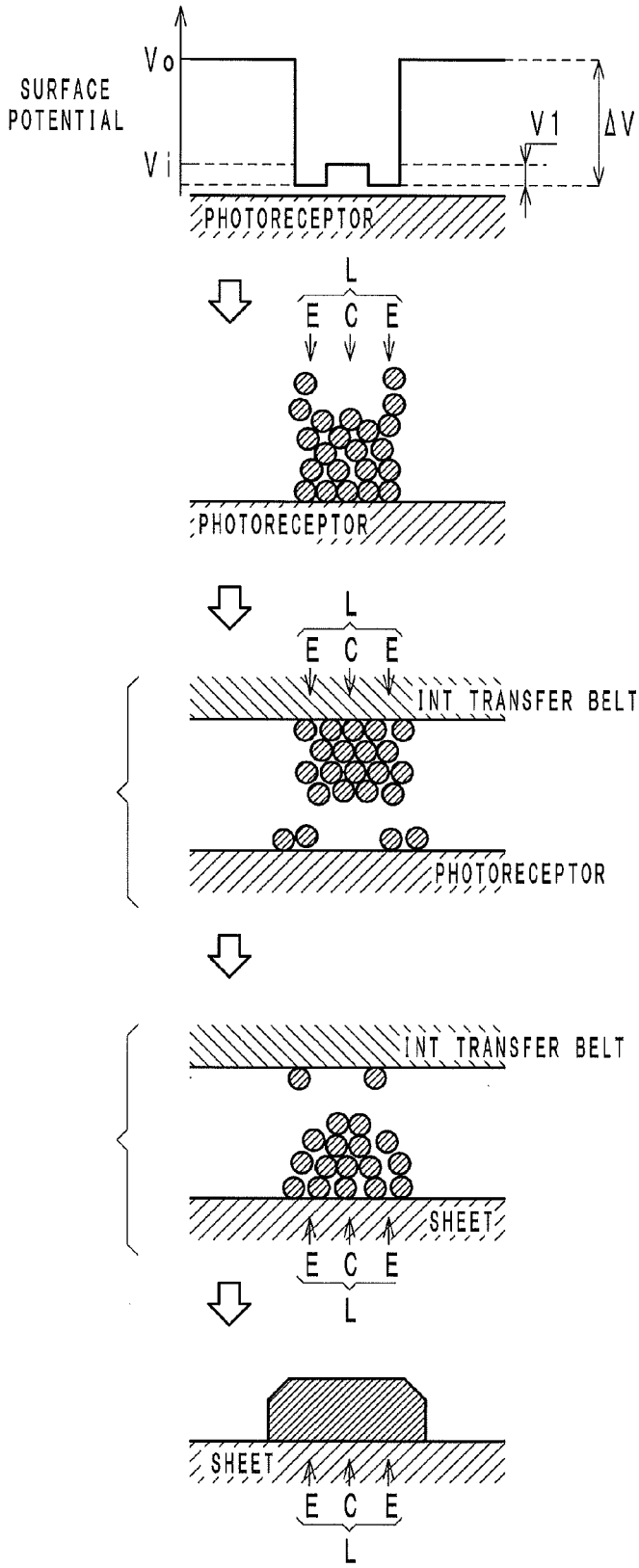
FIG. 1B is a view showing state transition of toner in a case where conventional edge intensification is carried out.
Figure 1C:
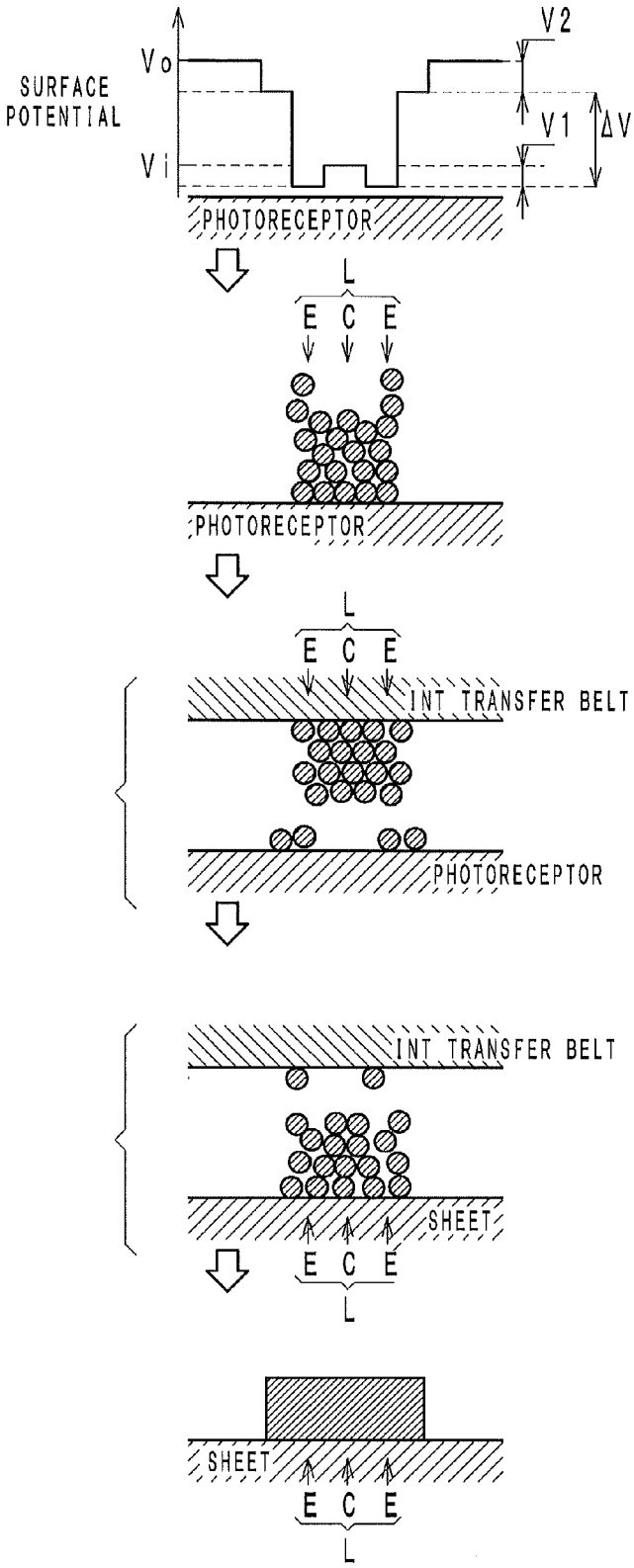
FIG. 1C is a view showing state transition of toner in a case where edge intensification according to an embodiment of the present invention is carried out.

A part of the non-image area W adjoined to the edge portion E is referred to as an edge-surrounding portion N. In this embodiment, exposure is carried out also toward the edge-surrounding portion N so as to attenuate the electric potential at the edge-surrounding portion N. More specifically, as shown in FIG. 1C, due to the increase in exposure amount for edge intensification, the electric potential at the edge portions E becomes lower by V1 than the electric potential Vi at the center portion C. Further, the edge-surrounding portion N is exposed such that the potential of the edge-surrounding portion N will be lower by V2 than the electric potential Vo (i.e., charged potential of the photoreceptor) at the parts of the non-image area W other than the edge-surrounding portion N. Here, V1<V2. Thereby, the electric potential difference between the pattern L and the non-image area W around the border can be reduced. Consequently, the toner supplied to the edge portions E can be transferred to the intermediate transfer belt, and the amount of toner remaining on the photoreceptor drum can be reduced, which results in a reduction in the waste of toner (see FIG. 1C).

In other words, the exposure amount on the edge portion E of the pattern is higher than the exposure amount on the center portion C (i.e., non-edge portion) by such a first exposure amount as to cause the electric potential attenuation V1. In the non-image area W, the exposure amount on the edge-surrounding portion N adjoined to the edge portion E is higher than the exposure amount on the parts of the non-image area W other than the edge-surrounding portion N by such a second exposure amount as to cause the electric potential attenuation V2. In this regard, if there is a linear correlation between the charged potential and the exposure amount on the photoreceptor, the second exposure amount is larger than the first exposure amount. If there is a non-linear correlation between the charged potential and the exposure amount on the photoreceptor, it is not always true that the second exposure amount is larger than the first exposure amount. This embodiment will be described below on the assumption that the second exposure amount is larger than the first exposure amount.

Introduction

An image forming apparatus adopting the basic idea above will be hereinafter described with reference to the accompanying drawings. First, words and terms are defined. In some of the drawings, X-axis, Y-axis and Z-axis are shown. The X-axis shows a right-left (i.e., horizontal) direction of the image forming apparatus, the Y-axis shows a front-back (i.e., depth) direction of the image forming apparatus, and the Z-axis direction shows an up-down (i.e., vertical) direction of the image forming apparatus. In the drawings, some components are provided with reference marks with suffixes A, B, C or D attached thereto. The suffixes A, B, C and D mean yellow (Y), magenta (M), cyan (C) and Black (Bk), respectively. For example, an image forming unit 5A means an image forming unit 5 for yellow (Y) images. Also, if none of the suffixes is attached to a reference mark although it is possible to attach any of the suffixes to the reference mark, the reference mark collectively means the components for the respective colors. For example, an image forming unit 5 collectively means the image forming units 5A to 5D for the respective colors.

Structure and Printing Operation of the Image Forming Apparatus

Figure 2:
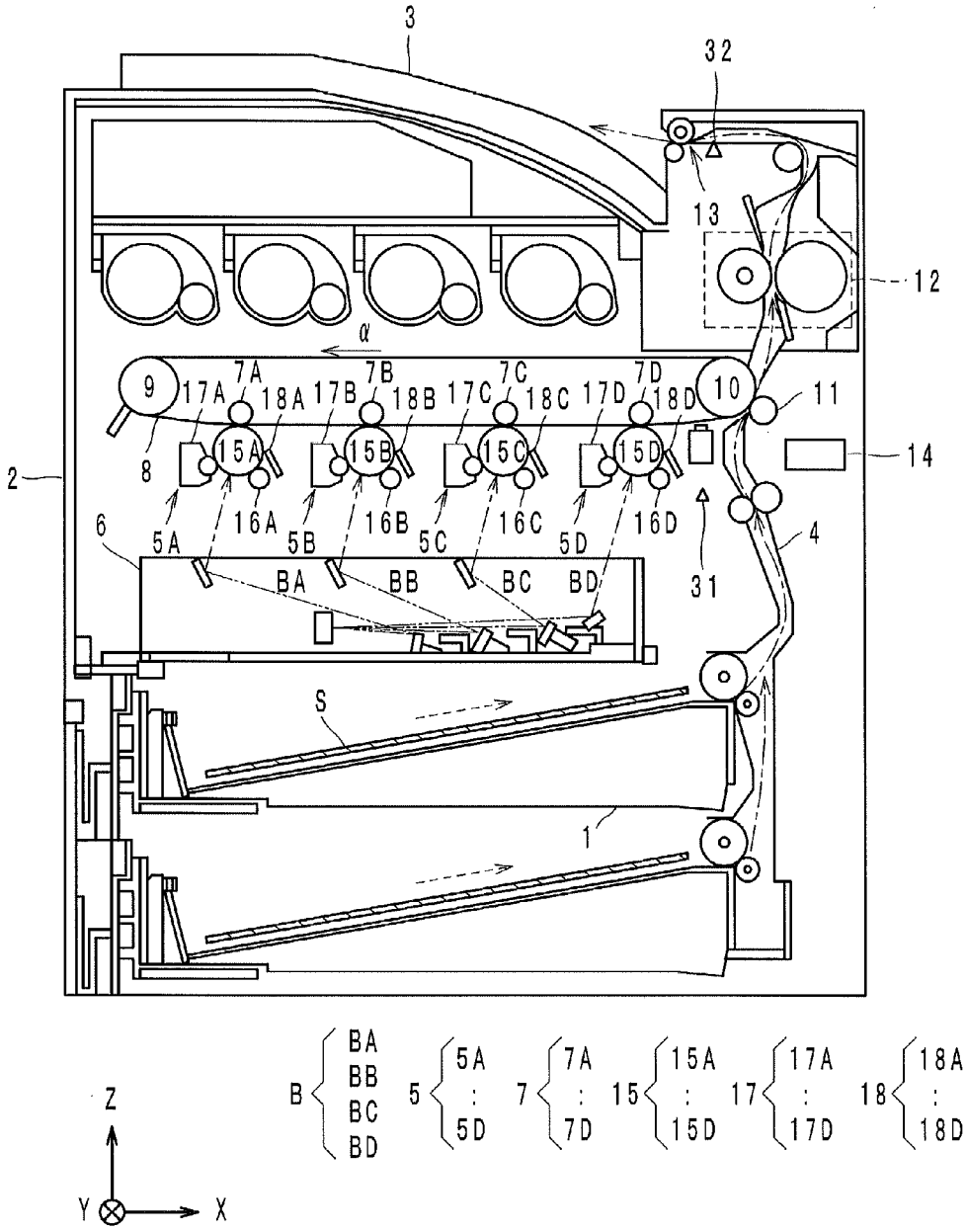
FIG. 2 is a sectional view of the general structure of an image forming apparatus according to an embodiment of the present invention.

First, referring to FIG. 2, the structure and the printing operation of the image forming apparatus are described. The image forming apparatus is an electrophotographic MFP (multifunction peripheral), and generally comprises a cassette 1, a body 2 and a tray 3.

The cassette 1 is located in a lower section of the image forming apparatus. In the cassette 1, a stack of unprinted sheets (for example, paper) is placed. The cassette 1 picks up one sheet S from the stack of sheets and feeds the sheet S out into a sheet feeding path 4 repeatedly with a rotating feed roller and other components, whereby the sheets are fed one by one.

The body 2 is located above the cassette 1. In the right side of the body 2, the sheet feeding path 4 is arranged as shown by an alternate long and short dash line. The sheet S fed out of the cassette 1 is introduced into the sheet feeding path 4. The sheet S travels in the sheet feeding path 4 toward the tray 3 in a downstream direction.

The body 2 forms an image on the sheet S traveling in the sheet feeding path 4, whereby a printed sheet is formed. More specifically, the body 2 adopts what is called a tandem method for full-color printing, and includes four image forming units 5A to 5D. Further, the body 2 includes an optical scanning device 6, primary transfer rollers 7A to 7D, an intermediate transfer belt 8, rollers 9 and 10, a secondary transfer roller 11, a fixing device 12, a pair of ejection rollers 13, and a control unit 14 for controlling the components.

The image forming units 5A to 5D are arranged in the body 2, in a line in the horizontal direction. In the case shown by the drawings, the image forming unit 5A is located farthest in the horizontal direction from the sheet feeding path 4, and the image forming units 5B, 5C and 5D are arranged in this order toward the sheet feeding path 4. The respective image forming units 5A to 5D have at least photoreceptor drums 15A to 15D, chargers 16A to 16D, developing devices 17A to 17D, and cleaning blades 18A to 18D.

The photoreceptor drums 15 for the respective colors extend in the depth direction of the image forming apparatus, and are rotated by a driving force generated by a motor (not shown).

The chargers 16 for the respective colors each have, for example, a charging roller or a charging electrode extending in parallel to the corresponding photoreceptor drum 15. If a charging bias voltage is applied to the chargers 16, the chargers 16 charge the rotating photoreceptor drums 15 uniformly.

Now, the optical scanning device 6 is described. Image data are input to the optical scanning device 6 from the control unit 14, which will be described later. The optical scanning device 6 generates light beams BA to BD modulated in accordance with the input image data. Thereafter, the optical scanning device 6 irradiates the surfaces of the photoreceptor drums 15A to 15D with the light beams BA to BD so as to form electrostatic latent images. The exposure amounts on the photoreceptor drums 15A to 15D at this stage are controlled by the control unit 14. The exposure amount control will be described later.

The developing devices 17 for the respective colors each have a developing roller. The developing roller is located between an irradiation position where the corresponding photoreceptor drum 15 is irradiated with the light beam and a primary transfer position, which will be described later, and the developing roller is arranged in parallel to the corresponding photoreceptor drum 15. A developing bias voltage Vd is applied to the developing rollers, thereby generating development electric fields between the respective pairs of a developing roller and a photoreceptor drum 15.

In the developing devices 17, for example, a two-component developer is stored. The two-component developer in each of the developing devices 17 is stirred by a built-in stirring screw and thereby is friction-charged. The two-component developer is supplied to the developing roller with rotation of a built-in supply screw.

By the effects of the development electric fields generated between the respective pairs of a developing roller and a photoreceptor drum 15, the developing rollers supply toner to the surfaces of the photoreceptor drums 15, whereby the electrostatic latent images formed on the photoreceptor drums 15 are developed. Consequently, on the surfaces of the photoreceptor drums 15, toner images (that is, visible images) in the respective colors are formed.

The intermediate transfer belt 8 is laid between the rollers 9 and 10 as an endless belt. The intermediate transfer belt 8 is arranged such that the lower surface of the intermediate transfer belt 8 is in contact with the surfaces of the photosensitive drums 15. The intermediate transfer belt 8 is rotated in a direction shown by arrow a by the rollers 9 and 10, which are rotated by a driving force generated by a motor (not shown).

The primary transfer rollers 7A to 7D for the respective colors are located to face the surfaces of the photoreceptor drums 15A to 15D for the respective colors via the intermediate transfer belt 8. The primary transfer positions mentioned above mean the positions where the intermediate transfer belt 8 faces the photoreceptor drums 15A to 15D. If the toner images supported on the respective photoreceptor drums 15A to 15D are conveyed to the respective primary transfer positions, the corresponding primary transfer rollers 7A to 7D transfer the images onto the intermediate transfer belt 8 that is rotating in the direction a (i.e., primary transfer). The primary transfer is carried out such that the single-color images are transferred substantially on the same position of the transfer belt 8. Thereby, on the surface of the intermediate transfer belt 8, the single-color images are combined, and a composite toner image can be formed. Thereafter, the composite toner image is kept supported on the intermediate transfer belt 8 and is conveyed to a transfer nip portion, which will be described later.

The secondary transfer roller 11 is arranged to face the roller 10 via the intermediate transfer belt 8. The secondary transfer roller 11 and the intermediate transfer belt 8 are in contact with each other, thereby forming a transfer nip portion. The sheet S introduced into the sheet feeding path 4 by the cassette 1 is fed into the transfer nip portion. A transfer bias voltage is applied to the secondary transfer roller 11, and the composite toner image is attracted to the secondary transfer roller 11 by the transfer bias voltage. Consequently, the composite toner image is transferred onto the sheet S fed into the transfer nip portion (i.e., secondary transfer). The sheet S after the secondary transfer is fed to the fixing device 12.

The fixing device 12 has a heating roller and a pressing roller. The contact portion between these rollers is referred to as a fixing nip portion. The sheet S fed from the transfer nip portion is introduced into the fixing nip portion. Heat and pressure are applied to the sheet S that is passing through the fixing nip portion. Thereby, the composite toner image is fixed on the sheet S. Thereafter, the sheet S is fed downstream from the fixing nip portion in the sheet feeding path 4.

The sheet S fed from the fixing device 12 is introduced into between the pair of ejection rollers 13, and is ejected onto the tray 3 as a printed sheet.

As described above, the toner images supported on the photoreceptor drums 15 are transferred to the intermediate transfer belt 8 by the operation of the primary transfer rollers 7. At this stage, the toner partly remains on the surfaces of the photoreceptor drums 15. The residual toner is scraped off the surfaces of the photoreceptor drums 15 with the cleaning blades 18, which are provided for the respective photoreceptor drums 15 so as to be located between the corresponding primary transfer position and the corresponding charger 16.

Exposure Amount Control

Figure 3:
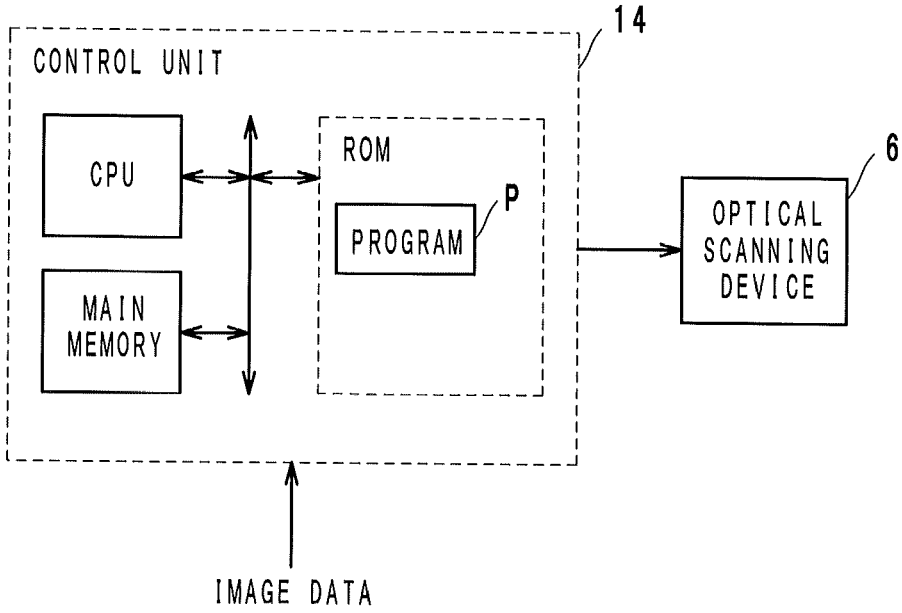
FIG. 3 is a block diagram showing a main part of the image forming apparatus shown by FIG. 1.
Figure 4:
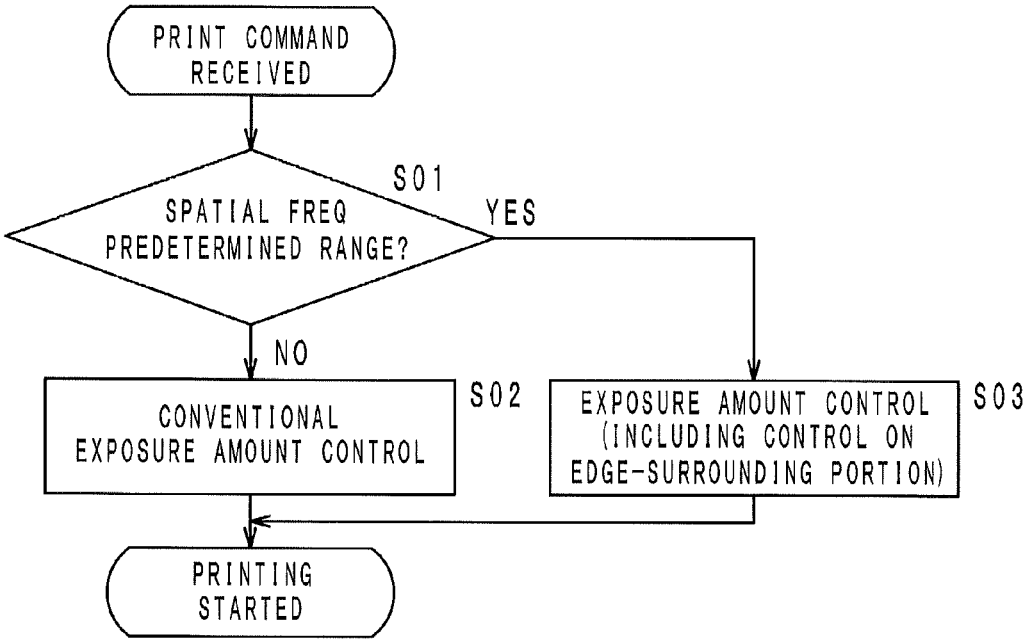
FIG. 4 is a flowchart showing a procedure carried out by a control unit.

The control unit 14, as shown by FIG. 3, typically includes a ROM, a CPU and a main memory, which are mounted on a control board. The CPU, for example, runs, on the main memory, various program pre-stored in the ROM. Thus, the CPU operates to implement various functions. As one of the functions, the CPU implements a program P for exposure amount control. The operation of the control unit 14 is hereinafter described with reference to FIG. 4.

The image forming apparatus receives a print command and image data from a personal computer connected thereto. Responsive to the print command, the control unit 14 judges from the analysis result of the image data or the like whether the image data concurrently sent thereto include a pattern with a predetermined spatial frequency (S01). More specifically, it is judged whether there is any pattern with a spatial frequency within a specified range (for example, within a range from 0.1 c/mm to 3.0 c/mm).

If the result at S01 is "NO", conventional exposure amount control is carried out (S02). If the result at step S01 is "YES", on the other hand, a glossiness change that will occur at the edge portions in the pattern will be likely to be visually recognized as noise by a viewer (i.e., a person who looks at the pattern), and in order to avoid this, processing is carried out at step S03. The processing at step S03 is hereinafter described.

The control unit 14 handles a pattern with a spatial frequency within a range from 0.1 c/mm to 3.0 c/mm in the way as described with reference to FIG. 1C. First, the exposure amounts on the edge portions E are increased so that the amount of toner adhering to the edge portions E will be increased. Second, the control unit 14 decreases the electric potential difference between an image area I and the border portion of a non-image area W so that the force to restrain toner around the edge portions E can be weakened. For this purpose, the control unit 14 makes the optical scanning device 6 perform exposure of the edge-surrounding portion N also so as to lower the electric potential at these portions N.

Due to the increase in exposure amount for edge intensification, the electric potential at the edge portions E becomes lower than the electric potential Vi at the center portion C by V1. The electric potential at the edge-surrounding portion N becomes lower than the electric potential Vo at the parts of the non-image area W other than the edge-surrounding portion N by V2. Here, V1<V2.

The potential attenuation characteristic of the photoreceptor drums 15 in response to the exposure amount (i.e., irradiation energy) applied thereto after the electric charge to the electric potential Vo is pre-stored in the ROM of the control unit 14. From the potential attenuation characteristic, the increments in exposure amount to cause the electric potential attenuation V1 and the electric potential attenuation V2 can be calculated.

The charged electric potential Vo on the photoreceptor drums 15 and the DC component of the developing bias voltage Vd are set such that there is such a specified electric potential difference as to prevent toner fogging (i.e., anti-fogging margin). The specified electric potential difference is, for example, within a range from 50V to 200V. It is preferred that V2 is set smaller than the specified potential difference.

Function and Effect of the Exposure Amount Control

The exposure amount control described above allows the electric potential difference between the pattern L and the border portion of the non-image area W to be smaller than that in a conventional apparatus. Thereby, the force to restrain toner around the edge portions E can be weakened. Consequently, almost all of the toner supplied to the edge portions E can be transferred to the intermediate transfer belt, and the amount of toner remaining on the photoreceptor drums can be extremely reduced. This reduces waste of toner.

Modification

Figure 5:
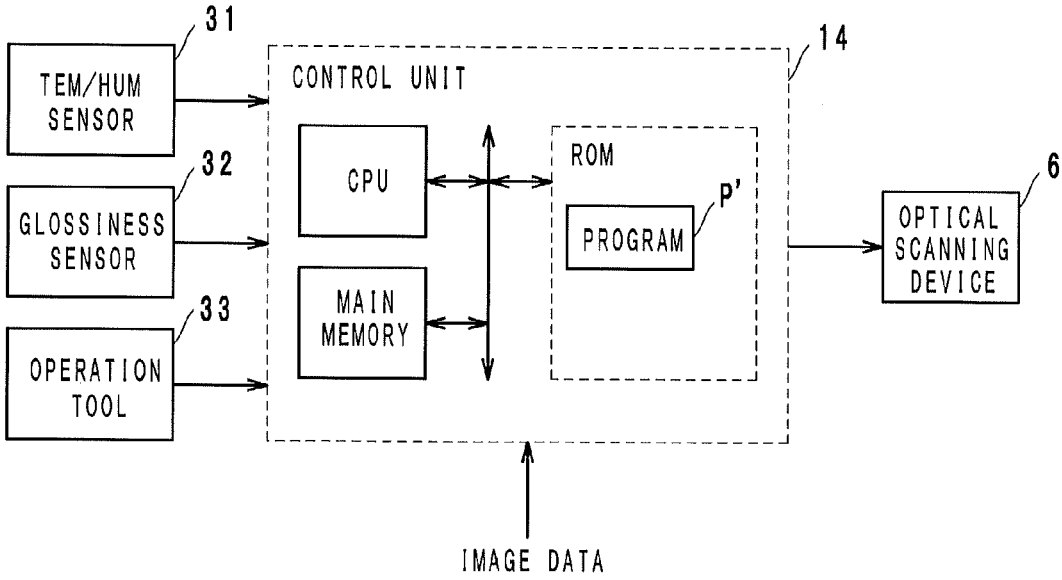
FIG. 5 is a block diagram showing a main part of an image forming apparatus according to a modification.
Figure 6A:
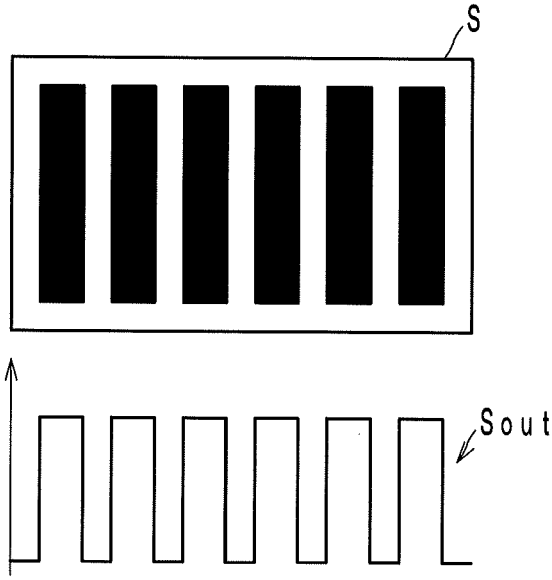
FIG. 6A is a chart showing an output signal from a glossiness sensor in a case where there occurs glossiness unevenness.
Figure 6B:
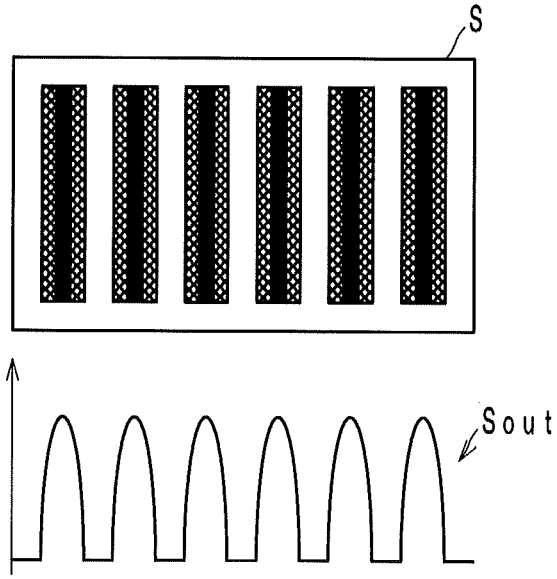
FIG. 6B is a chart showing an output signal from a glossiness sensor in a case where there occurs no glossiness unevenness.
Figure 7:
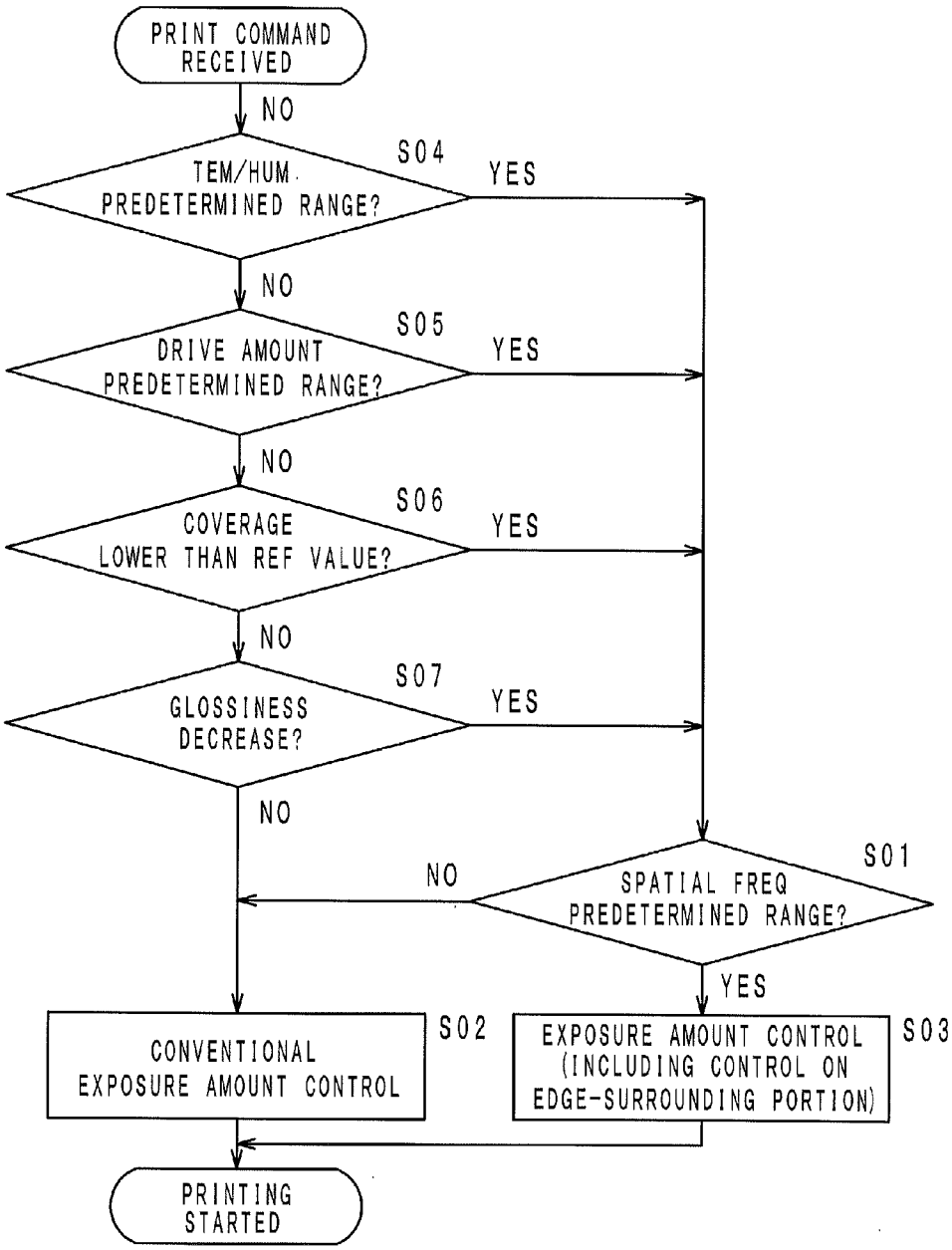
FIG. 7 is a flowchart showing a procedure carried out by the control unit shown by FIG. 5.

Next, referring to FIGS. 5 to 7, a modification from the above-described embodiment is described. As is apparent from the comparison between FIG. 3 and FIG. 5, a modified image forming apparatus is different from the image forming apparatus described above in the following points: the modified image forming apparatus further comprises a temperature and humidity sensor 31, a glossiness sensor 32 and an manual operation device 33; and the control unit 14 of the modified image forming apparatus implements a program P' for exposure amount control.

The temperature and humidity sensor 31 is located, for example, around the image forming units 5A to 5D. The temperature and humidity sensor 31 detects the temperature and the humidity around itself and sends signals indicating the temperature and the humidity, respectively (which will be hereinafter referred to as a temperature signal and a humidity signal, respectively) to the control unit 14.

The glossiness sensor 32 is located in the sheet feeding path 4, downstream of the fixing device 12. The glossiness sensor 32 measures the glossiness of the image on a sheet S after subjected to the fixing process, and sends a signal indicating the measurement result to the control unit 14. A typical example of the glossiness sensor 32 is an optical active sensor. The active sensor emits light to the image on a sheet S after subjected to the fixing process and detects the energy of specularly-reflected light (or the energy of diffusedly-reflected light), and sends a signal indicating the detection result to the control unit 14. At this stage, if the image on the sheet S has no glossiness unevenness (see the upper level of FIG. 6A), the output signal $S_{out}$ from the glossiness sensor 32 has steep edges (see the lower level of FIG. 6A). On the other hand, if the image on the sheet S has glossiness unevenness (see the upper level of FIG. 6B), the output signal $S_{out}$ from the glossiness sensor 32 has obtuse edges (see the lower level of FIG. 6B). In FIG. 6B, the glossiness unevenness is shown by the hatching density unevenness (i.e. uneven intervals between diagonal lines).

The manual operation device 33 is, for example, a touch panel located at the front side of the body 2. If a viewer visually recognizes a decrease in glossiness of an image on a printed sheet ejected onto the tray 3, the viewer operates the manual operation device 33 in a predetermined way. In response to the operation, a glossiness input screen is displayed on the manual operation device 33, and the viewer inputs information about the decrease in glossiness on the screen. The information input by the viewer is sent from the manual operation device 33 to the control unit 14.

Modified Exposure Amount Control

Next, modified exposure amount control is described with reference to FIG. 7. The flowchart shown by FIG. 7 for the modified exposure amount control is different from the flowchart shown by FIG. 4 in that the modified flowchart further has steps S04 to S07. There is no other difference between these two flowcharts.

Effects of Factors

As has been described with reference to FIGS. 1A to 1C, if the amount of toner adhering to the edge portions E on the sheet is smaller than the amount of toner adhering to the center portion C on the sheet, glossiness unevenness occurs. Factors that may decrease the amount of toner adhering to the edge portions E are the electric charge amount on toner and the mutual adhesion among toner particles (i.e., the Van der Waals force of toner), etc.

If the electric charge amount on toner is increased, the edge-restraining electric field generated by the electric potential difference between an image area and the border portion of a non-image area acts strongly, and consequently, the amount of toner adhering to the edge portions E on the sheet decreases. Also, if the mutual adhesion among toner particles becomes stronger, the amount of toner adhering to the edge portions E on the sheet decreases.

In the following, a modified exposure amount control procedure will be described. In the modified exposure amount control procedure, the exposure amount is controlled based on information about the temperature, the humidity, the utilization rate of the image forming unit and the coverage, which make an effect on the charge amount on toner and the adhesion among toner particles.

First, at step S04, the control unit 14 receives the temperature signal and the humidity signal from the temperature and humidity sensor 31, and from the received signals, the control unit 14 judges whether or not the image forming apparatus is, for example, under low-temperature and low-humidity environment. More specifically, it is judged whether or not the image forming apparatus is under a temperature of 10 degrees C. or lower and a humidity of 20% RH or lower. If the result of the judgment is "YES", it is judged that edge portions of a pattern with a predetermined spatial frequency formed by the image forming apparatus will be likely to have low glossiness. Then, a further judgment is made at step S01.

The control unit 14 monitors the utilization rate of the image forming unit 5, more specifically, the total operating time (i.e. the total duration of use) of each of the image forming units 5 from the initial state. At step S05, from the current value of the monitored total operating time, the control unit 14 judges whether or not the remaining life of the image forming unit 5 is long. If the result of the judgment is "YES", it is judged that edge portions of a pattern with the predetermined spatial frequency formed by the image forming unit 5 will be likely to have low glossiness. Then, a further judgment is made at step S01.

The control unit 14 also calculates the coverage of an image on a printed sheet from the image data input thereto. At step S06, the control unit 14 judges whether or not the calculated coverage is lower than a reference value. If the coverage is lower than the reference value, it is judged that edge portions of a pattern with the predetermined spatial frequency included in the image will be likely to have low glossiness. Then, a further judgment is made at step S01. The low coverage causes the low glossiness of edge portions for the reason below. If the coverage is low, the consumption of toner in the printing job is low. Therefore, same toner particles exist in the developing device 17 for a long time, and the fluidity of toner becomes low, whereby the mutual adhesion between toner particles become stronger. Consequently, the primary transfer ends in faulty transfer wherein toner remains on the photoreceptor drum 15, and the edge portions will be likely to have low glossiness.

Also, if the measurement result of the glossiness sensor 32 or the information received at the manual operation device 33 shows low glossiness, the control unit 14 makes a judgment at step S01.

If the results of the judgments at steps S04 to S07 are "NO" or If the result at step S01 is "NO", the control unit 14 carries out the process at step S02. If the result of the judgment at step S01 is "YES", the control unit 14 carries out the process at step S03.

Function and Effect of the Modified Exposure Amount Control

According to the above-described modified exposure amount, only if a decrease in glossiness will be likely to occur, the control unit 14 carries out the process at step S1 of calculating the spatial frequency and making a judgment and the process at step S03 of controlling the exposure amount. Hence, the processing efficiency will be higher.

Supplementary Notes

The ROM of the control unit 14 may store data on the potential attenuation characteristic of the photoreceptor drums 15 in response to the exposure amount under a plurality of different temperature and humidity conditions, and from the data and the temperature and humidity information received at step S04, the exposure amount increments V1 and V2 may be calculated.

In the modified control procedure described above, if the image forming apparatus is judged to be under low-temperature and low-humidity environment at step S04, the process at step S1 is carried out. However, the control procedure may be composed such that if the image forming apparatus is judged to be under high-temperature and high-humidity environment at step S04, the process at step S1 is carried out. Under high-temperature and high-humidity environment, toner absorbs water, and the adhesion between toner particles becomes strong. Consequently, the primary transfer ends in faulty transfer, and toner is remained on the photoreceptor drums 15. Accordingly, the glossiness of the edge portions is likely to lower. Therefore, in order to avoid this trouble, the control procedure may be composed as follows: it is judged at step S04 whether or not the image forming apparatus is under high-temperature and high-humidity environment; and if the result of the judgment at step S04 is "YES", the process at step S01 is carried out.

In the modified control procedure described above, if the remaining life of the image forming unit 5 is judged as long at step S05, the process at step S01 is carried out. However, the control procedure may be composed such that if the remaining life of the image forming unit 5 is judged as short at step S05, the process at step S1 is carried out. If the remaining life of the image forming unit 5 is short, many toner particles have additives inside. In this case, therefore, the fluidity of toner is low, and the adhesion between toner particles is strong. Accordingly, the primary transfer ends in faulty transfer, and toner is remained on the photoreceptor drum 15. Accordingly, the glossiness of the edge portions is likely to lower. Therefore, in order to avoid this trouble, the control procedure may be composed as follows: it is judged at step S05 whether or not the remaining life of the photoreceptor drum 5 is short; and if the result of the judgment at step S05 is "YES", the process at step S01 is carried out.

In the modified control procedure described above, if the coverage is judged to be smaller than a reference value at step S06, the process at step S01 is carried out. However, the control procedure may be composed such that if the coverage is judged to be larger than another reference value, the process at step S01 is carried out. If the coverage is large, the consumption of toner is large, and it is considered that the developer contains a large amount of new toner. Accordingly, the average charge amount on toner is high, and the toner-restraining force around the edge portions E is stronger than usual. Therefore, the glossiness of the edge portions E is likely to lower. In order to avoid this trouble, the control procedure may be composed as follows: it is judged at step S06 whether or not the coverage is higher than a reference value; and if the result of the judgment at step S06 is "YES", the process at step S01 is carried out.

Implementation Experiment

In order to confirm the advantageous effects of the above-described embodiment, the inventor evaluated images formed by an actual image forming apparatus. The apparatus used for the evaluation was an image forming apparatus modified and improved from an electrophotographic color copying machine having resolution of 600 dpi (bizhub C574 produced by Konica Minolta Co., Ltd.).

A pattern that has a spatial frequency of 3.0 c/mm and is composed of lines with a width of four dots (for example, a character image composed of characters in 10 points) was printed out as Sample 1. In the edge intensification process according to this embodiment, both end portions of every four-dot line were subjected to exposure of 3.5 mJ/m$^2$, and the center portion with a width of two dots was subjected to exposure of 3.0 mJ/m$^2$. Further, the edge-surrounding portion around the line was subjected to exposure of 1.0 mJ/m$^2$.

An image with a spatial frequency of 3.0 c/m and with a medium coverage that is used, for example, as a medium-tone portion of a photographic image (for example, a gray image with a density of 50%) was printed out as Sample 2. Specifically, a pattern with four-dotted portions and four-non-dotted portions repeated alternately was printed out. For formation of Sample 2, the same exposure conditions as for formation of Sample 1 were applied.

An image with the same characteristics as Sample 2 except for having a spatial frequency of 0.1 c/mm was printed out as Sample 3.

The same pattern with Sample 1 was printed out as Comparative Sample 1. The pattern of Comparative Sample 1 was, however, formed with every four-dot line entirely subjected to exposure of 3.5 mJ/m$^2$.

An image with a spatial frequency of 0.095 c/mm and with a high coverage that is used, for example, as a high-tone portion of a photographic image (for example, a gray image with a density of 90%) was printed out as Comparative Sample 2. Specifically, a pattern with 200-dotted portions and 50-non-dotted portions repeated alternately was printed out. For formation of Comparative Sample 2, the same exposure conditions as for formation of Sample 1 were applied.

An image with a spatial frequency of 12.0 c/mm and with a low coverage that is used, for example, as a low-tone portion of a photographic image (for example, a gray image with a density of 10%) was printed out as Comparative Sample 3. Specifically, a pattern with one-dotted portions and one-non-dotted portions repeated alternately was printed out. For formation of Comparative Sample 3, the same exposure conditions as for formation of Sample 1 were applied.

The same pattern with Sample 1 was printed out as Comparative Sample 4. For formation of Comparative Sample 4, exposure conditions according to a conventional edge intensification process were applied. Specifically, with respect to every four-dot line, the both edge portions were subjected to exposure of 3.5 mJ/m$^2$, and the center portion with a width of two dots was subjected to 3.0 mJ/m$^2$. The edge-surrounding portion around the line was not subjected to exposure.

The inventors formed Samples 1-3 and Comparative Samples 1-4 by use of the above-described image forming apparatus under the conditions above and further under circumstances to readily cause a decrease in glossiness of the edge portions. Then, the inventors evaluated the output images in picture quality and in toner consumption. Table 1 below shows the results.

TABLE 1

| | Image | Spatial Frequency [c/mm] | Exposure Control | Edge Glossiness Decrease | Toner Consumption | Evaluation |
|---|---|---|---|---|---|---|
| Sample 1 | 10-point Character Image | 3 | With Inventive Exposure Control | A | A | A |
| Sample 2 | 50% Gray Image | 3 | With Inventive Exposure Control | A | A | A |
| Sample 3 | 50% Gray Image | 0.1 | With Inventive Exposure Control | A | A | A |
| Comparative Sample 1 | 10-point Character Image | 3 | With No Exposure Control | C | A | C |
| Comparative Sample 2 | 90% Gray Image | 0.095 | With Inventive Exposure Control | B | A | B |
| Comparative Sample 3 | 10% Gray Image | 12 | With Inventive Exposure Control | B | A | B |
| Comparative Sample 4 | 10-point Character Image | 3 | With Conventional Edge Intensification | C | A | C |

In Table 1 above, in the column of "Edge Glossiness Decrease", "A" means that there was an improvement in prevention of a decrease in glossiness and that an improvement in picture quality could be confirmed visually. On the contrary, "C" means that there was not an improvement in prevention of a decrease in glossiness and that an improvement in picture quality could not be confirmed visually. Also, "B" means that there was an improvement in prevention of a decrease in glossiness but that an improvement in picture quality could not be confirmed visually.

In the column of "Toner Consumption", "A" means that the amount of waste toner did not change or decreased. On the contrary, "C" means that the amount of waste toner increased.

If both the edge glossiness decrease and the toner consumption are marked with "A", "A" is written in the box of "Evaluation". If the edge glossiness decrease and the toner consumption are marked with "A" and "C" respectively, "C" is written in the box of "Evaluation". If the edge glossiness decrease and the toner consumption are marked with "B" and "A" respectively, "B" is written in the box of "Evaluation". If the edge glossiness decrease and the toner consumption are marked with "C" and "A" respectively, "C" is written in the box of "Evaluation". If both the edge glossiness decrease and the toner consumption are marked with "C", "D" is written in the box of "Evaluation".

As is apparent from Table 1, even if a pattern with a spatial frequency within a range from 0.1 c/mm to 3.0 c/mm, which is likely to be seen as noise, is printed out under circumstances to readily cause a decrease in glossiness, it is possible to prevent a decrease in glossiness on the output image while preventing an increase in toner consumption by carrying out a conventional edge intensification process and an additional exposure control process to make the exposure amount on the edge-surrounding portion N in the non-image area W adjoined to the edge portion E higher by the second exposure amount than the exposure amount on the portions of the non-image area W other than the edge-surrounding portion N.

As described above, the image forming apparatus according to this embodiment can prevent a decrease in glossiness while preventing an increase in toner consumption.

Although the present invention has been described in connection with the preferred embodiments above, it is to be noted that various changes and modifications may be possible for those who are skilled in the art. Such changes and modifications are to be understood as being within the scope of the present invention.

What is claimed is:

1. An image forming apparatus comprising:

a photoreceptor;

a charger configured to charge a specified electric potential on a surface of the photoreceptor;

an optical scanning device configured to emit a light beam to expose the surface of the photoreceptor charged by the charger to form an electrostatic latent image on the surface of the photoreceptor;

a developing device configured to develop the electrostatic latent image formed by the optical scanning device to form a toner image on the surface of the photoreceptor;

a transfer member configured to transfer the toner image formed by the developing device to a sheet and for feeding the sheet;

a fixing device configured to apply heat and pressure to the sheet fed from the transfer member to fix the toner image on the sheet; and a control unit configured to control an exposure amount from the optical scanning device, wherein:

for formation of an image having a pattern with a spatial frequency within a range from 0.1 c/mm to 3.0 c/mm, the control unit is configured to carry out exposure amount control such that an exposure amount on an edge portion of the pattern becomes higher than an exposure amount on a non-edge portion of the pattern by a first exposure amount so that after the exposure, an electric potential at the edge portion of the pattern will be different from an electric potential Vi at the non-edge portion of the pattern by a first voltage V1 and such that an exposure amount on an edge-surrounding portion of a non-image area adjoined to the edge portion of the pattern becomes higher than an exposure amount on portions of the non-image area other than the edge-surrounding portion by a second exposure amount so that after the exposure, an electric potential at the edge-surrounding portion of the non-image area will be different from an electric potential Vo at the other portions of the non-image area by a second voltage V2 that is larger than the first voltage V1.

2. The image forming apparatus according to claim 1, wherein the first exposure amount is greater than the second exposure amount.

3. The image forming apparatus according to claim 1, wherein the control unit is configured to control an exposure amount for formation of an image having a pattern with a spatial frequency within a range from 0.1 c/mm to 3.0 c/mm, if temperature and humidity around the image forming apparatus meet a predetermined condition.

4. The image forming apparatus according to claim 1, wherein the control unit is configured to monitor a utilization rate of an image forming unit including the photoreceptor, the charger and the developing device, and if the monitored utilization rate meets a predetermined condition, the control unit is configured to carry out the exposure amount control for formation of an image having a pattern with a spatial frequency within a range from 0.1 c/mm to 3.0 c/mm.

5. The image forming apparatus according to claim 1, wherein the control unit is configured to calculate a coverage of the image on the sheet, and if the calculated coverage meets a predetermined condition, the control unit is configured to carry out the exposure amount control for formation of an image having a pattern with a spatial frequency within a range from 0.1 c/mm to 3.0 c/mm.

6. The image forming apparatus according to claim 1, further comprising a manual operation device configured to permit a user to manually input information, wherein if information indicative of a decrease in glossiness, which is visually recognized on the sheet fed from the fixing device, is input through the manual operation device, the control unit is configured to carry out the exposure amount control for formation of an image having a pattern with a spatial frequency within a range from 0.1 c/mm to 3.0 c/mm.

7. The image forming apparatus according to claim 1, further comprising a glossiness sensor configured to detect glossiness of the image on the sheet fed from the fixing device, wherein if an output from the glossiness sensor meets a predetermined condition, the control unit is configured to carry out the exposure amount control for formation of an image having a pattern with a spatial frequency within a range from 0.1 c/mm to 3.0 c/mm.

* * * * *